US006584906B2

(12) United States Patent
Hartmann et al.

(10) Patent No.: US 6,584,906 B2
(45) Date of Patent: Jul. 1, 2003

(54) WARHEAD TRIGGERING IN TARGET-TRACKING GUIDED MISSILES

(75) Inventors: Ulrich Hartmann, Uhldingen (DE); Thomas Schilli, Frickingen (DE)

(73) Assignee: Bodenseewerk Gerätetechnik GmbH, Überlingen/Bodensee (DE)

( * ) Notice: Subject to any disclaimer, the term of this patent is extended or adjusted under 35 U.S.C. 154(b) by 0 days.

(21) Appl. No.: 09/877,346

(22) Filed: Jun. 8, 2001

(65) Prior Publication Data

US 2003/0047102 A1 Mar. 13, 2003

(30) Foreign Application Priority Data

Jun. 10, 2000 (DE) ..... 100 28 746

(51) Int. Cl.[7] ..... F42C 1/00; F42C 13/00
(52) U.S. Cl. ..... 102/211; 102/213; 102/216
(58) Field of Search ..... 102/211, 213, 102/214, 216

(56) References Cited

U.S. PATENT DOCUMENTS 3,850,103 A * 11/1974 Krupen ..... 102/213
4,168,663 A * 9/1979 Kohler ..... 102/214
4,388,867 A * 6/1983 Baumer ..... 102/211
5,696,347 A * 12/1997 Sebeny, Jr. et al. ..... 102/214

FOREIGN PATENT DOCUMENTS

DE 39 26 549 C1 * 2/1991 ..... 102/213
JP 3-84400 * 4/1991 ..... 102/213
JP 3-87600 * 4/1991 ..... 102/213

* cited by examiner

*Primary Examiner*—Stephen M. Johnson
(74) *Attorney, Agent, or Firm*—Scully, Scott, Murphy & Presser

(57) ABSTRACT

The invention relates to a method and a device for triggering a warhead in a target-tracking guided missile. The guided missile has an impact fuse and a proximity fuse for triggering detonation of the warhead. The invention triggers the warhead such that the damage caused to the target, such as an enemy fighter aircraft, becomes maximal. To this end, the miss disdance is predicted from influencing variabled detected during the flight of the guided missile. The warhead triggering delay time of the proximity fuse is set dependent on the predicted miss distance to achieve such maximum damage.

31 Claims, 12 Drawing Sheets

WARHEAD TRIGGERING IN TARGET-TRACKING GUIDED MISSILES

BACKGROUND OF THE INVENTION

The invention relates to a method of triggering a warhead in target-tracking guided missiles, which have an impact fuse and a proximity fuse for triggering a warhead.

Furthermore the invention relates to a device for triggering a warhead in target-tracking guided missiles, which have an impact fuse and a proximity fuse for triggering a warhead, the proximity fuse triggering the warhead with a warhead triggering delay time.

Target tracking guided missiles usually have an impact fuse trigger and a proximity fuse trigger for triggering a warhead. The proximity fuse trigger triggers the warhead with a delay time, herein called "warhead triggering delay time".

Target-tracking guided missiles are guided to a target by means of a seeker head. Usually, such seeker head comprises an image-resolving detector, conventionally a two-dimensional array of detector elements. The picture thus obtained of a scenario containing the target is applied to image processing means. Guidance signals are derived from the image processing, the missile being guided to the target by these guidance signals. When the missile more closely approaches the target, the seeker head will provide an image of the target, which becomes the larger the smaller the distance to the target is.

The guided missile contains a warhead, i.e. an explosive charge, and the target is to be destroyed by this explosive charge with maximum probability. The trajectory of the guided missile may deviate from the ideal trajectory due to various influences. This deviation may be due, for example, to the relative geometry of missile and target, if the target makes an evasive maneuver, to inaccuracies of the guidance of the guided missile, or to limitations of the maneuverability of the guided missile. In such case, the guided missile will not hit the target at the optimal aim point. The guided missile may even miss the target at a more or less large distance. The guided missile has an impact fuse trigger. The impact fuse trigger triggers the warhead, when the guided missile hits the target directly. Furthermore, the guided missile has a proximity fuse trigger. The proximity fuse trigger responds, when the guided missile has approached the target sufficiently. The proximity fuse trigger will trigger the warhead even if the guided missile misses the target. Triggering is effected with a warhead triggering delay time, after the proximity fuse trigger has responded. The warhead triggering delay time is selected such that the warhead, during the passage past the target, is triggered at a moment, when the detonating warhead and the fragments blasted off cause maximum damage to the target. Conventionally, the warhead triggering delay time is a fixed, empirically found value.

DISCLOSURE OF THE INVENTION

It is an object of the invention, to trigger the warhead of a guided missile such that maximum damage to the target is caused.

To this end, influencing variables are detected which influence the type of encounter of the guided missile with the target, and the warhead triggering delay time is set depending on such influencing variables. Preferably, a miss distance is predicted from influencing variables detected during the flight. The warhead triggering delay time of the proximity fuse is set depending on the miss distance thus predicted.

Accordingly, the guided missile contains means for detecting influencing variables influencing the miss distance during the flight of the guided missile means for determining a predicted miss distance from theses influencing variables and setting means for setting the warhead triggering delay time depending on the miss distance thus predicted.

If the image of a target such as a fighter aircraft is considered, a desired aimpoint can be defined thereon, in which the target ought to be hit by the guided missile to ensure maximum destructive effect of the warhead. Starting from this desired aimpoint, miss distances can be defined with regard to amount and direction of the miss. In accordance with the basic concept of the invention, this miss distance is predicted depending on various observable influencing variables. The warhead triggering delay time is set as a function of this predicted miss distance.

This can be done, for example, by setting a long warhead triggering delay time, if the predicted miss distance permits a direct hit to be anticipated, whereby the warhead will be triggered by the impact fuse upon impact of the guided missile on the target. If, however, the predicted miss distance lets a passage of the guided missile past the target to be expected, a warhead triggering delay time will be set which is optimized with regard to the efficiency of the detonating warhead.

The relation between the miss distance and both the influencing variables and the time-to-go can be derived by simulation and can be stored.

Influencing variables may be guidance-specific variables, such as the sight line rate, which result from the geometry of target and guided missile. The influencing variables may, however, also be missile-specific variables, such as control surface deflection or lateral acceleration. These influencing variables become effective, above all, if the guided missile gets near its limits of maneuverability.

The time-to-go can be derived from the image processing of a target image provided by an image resolving seeker head of the guided missile. Preferably, however, a predicted miss distance is continuously determined for a certain selected time-to-go. The miss distance predicted in this way for a selected time-to-go is output for determining the warhead triggering delay time with a delay equal to this selected time-to-go, when the proximity fuse responds.

Influencing variables, such as the sight line rate, are continuously determined. On the basis of these influencing variables, the predicted miss distances are computed for a selected time-to-go. The miss distances thus computed or determined are output with a delay equal to the time-to-go on which the computation or other determination was based. Thus, when the proximity fuse responds, predicted miss distances are available which were measured the selected time-to-go ago and now refer to the moment at which the proximity fuse responds. Thus no time-to-go estimates are necessary. Such estimation would usually be rather inaccurate.

Such a miss distance based on one single time-to-go may be corrupted by noise. Therefore, advantageously, predicted miss distances are determined from the influencing variables in parallel for different times-to-go. Each of these miss distances determined for an associated time-to-go is made available for the determination of the warhead triggering delay time, when the proximity fuse responds, delayed by this associated time-to-go. An average or weighted average of the predicted miss distances output with time delay is used to determine the warhead triggering delay time.

An embodiment of the invention is described hereinbelow with reference to the accompanying drawings.

DETAILED DESCRIPTION OF PREFERRED EMBODIMENT

The guided missile has an impact fuse, which responds, when the guided missile hits the target directly, and which triggers the warhead within the interior of the target, maybe with a very small triggering delay. Furthermore, the guided missile has a proximity fuse. The proximity fuse responds, when the guided missile has approached the target to within a small distance. The proximity fuse fires also, if the the guided missile does not hit the target directly but misses the target at a small distance. Here, triggering of the warhead is usually effected with a warhead triggering delay time. A detonating warhead of a guided missile has two effects, namely a pressure effect and a fragment effect. The pressure effect becomes effective, above all, if the warhead detonates within the target or in direct proximity of the target. When the warhead detonates outside the target, the target can be destroyed or damaged by the effect of missile fragments. If the guided missile achieves a direct hit, then it is the best, if the warhead is triggered by the impact fuse. If the missile misses the target, the warhead is triggered by the proximity fuse with such a warhead triggering delay time, that maximum fragment effect is achieved.

Often, the detection point of the proximity fuse is poorly defined. This detection point may, for example, depend on the type of target or on the direction from which the guided missile approaches the target. Therefore, it may happen that, if the proximity fuse responds early and a fixed value of the warhead triggering delay time is selected, the warhead is triggered, before the guided missile hits the target, even if without this premature triggering the guided missile would have achieved a direct hit. Then the effect of the warhead would not be maximal, and the probability of kill would be reduced. In this case, a longer warhead triggering delay time of the proximity fuse would have been better, as this longer warhead triggering delay time would have permitted the impact fuse to become operative. If, on the other hand, a longer warhead triggering delay time of the proximity fuse were selected, then triggering of the warhead could be effected too late in the case of missing of the target, whereby the fragment effect of the warhead would be insufficient and, again, the probability of kill is reduced.

For this reason, the warhead triggering delay time is made dependent on the predicted miss distance.

The "miss distance" will be explained with reference to FIG. 1.

Figure 1:
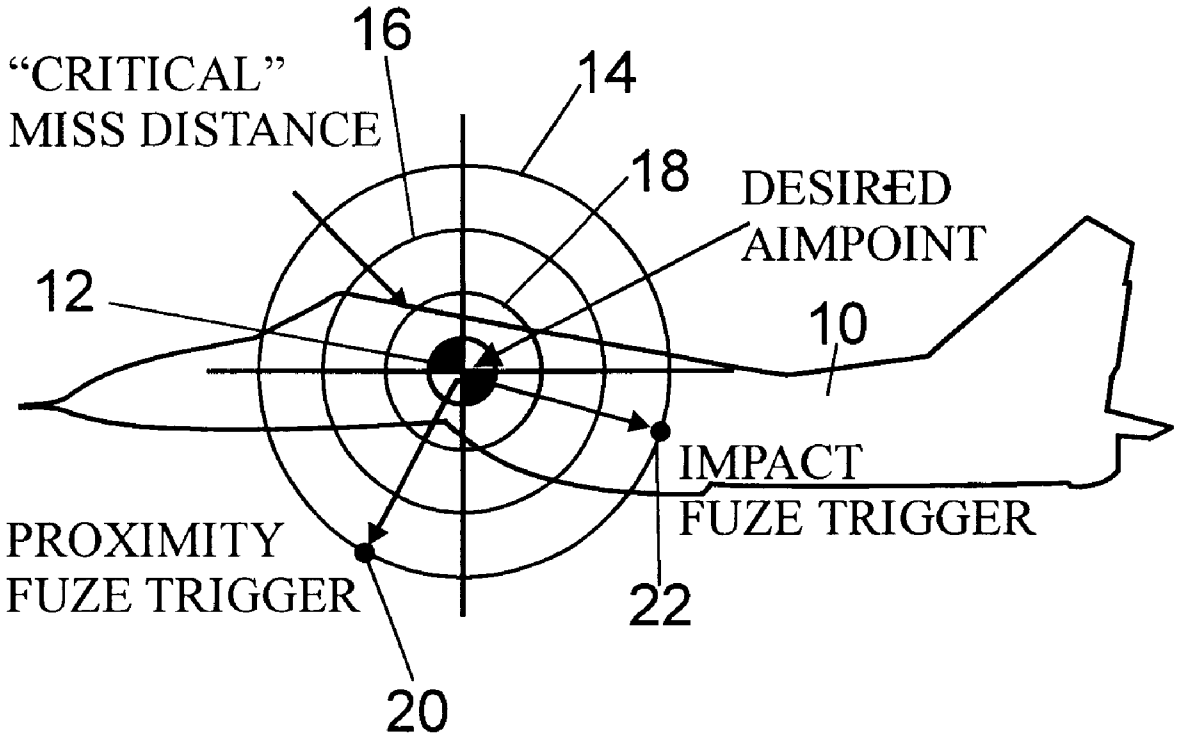
FIG. 1 illustrates the definition of the miss distance and of the "critical miss distance" with reference to a target detected by the seeker of the guided missile.

Referring to FIG. 1, numeral 10 designates a target, in the present case an enemy fighter plane, as viewed by the image resolving detector of the guided missile. A "desired aimpoint" is located on this target. When the guided missile directly hits this desired aimpoint, maximum effect of the warhead is ensured. This desired aimpoint is designated by numeral 12 in FIG. 1. As a rule, the actual hit point deviates from this desired aimpoint both with respect to distance and with respect to direction. This is the "miss distance". The miss distances are illustrated in FIG. 1 by circles 14, 16, 18 similar to a target disc. If the hit point is still within the inner circle 18, which defines a "critical miss distance", there will still be a direct hit, i.e. the guided missile hits the target directly. With larger miss distances, the guided missile may miss the target 10. Then the warhead is triggered by the proximity fuse, as illustrated in FIG. 1 by point 20. It is, however, possible that, even with miss distances of larger amounts, a direct hit is achieved, as illustrated by point 22 in FIG. 1. When the guided missile passes the target through point 20, the warhead is triggered by the proximity fuse with optimal warhead triggering delay time, whereby maximum fragment effect is achieved. When the guided missile hits the target within circle 18 or also in point 22, the impact fuse is to become operative.

Now, in accordance with the basic concept of the invention, the hit point is predicted on the basis of observable influencing variables. This will be explained with reference to FIGS. 2 to 4 for the influencing variable "sight line rate $\dot{\sigma}$" and for the planar case.

Figure 2:
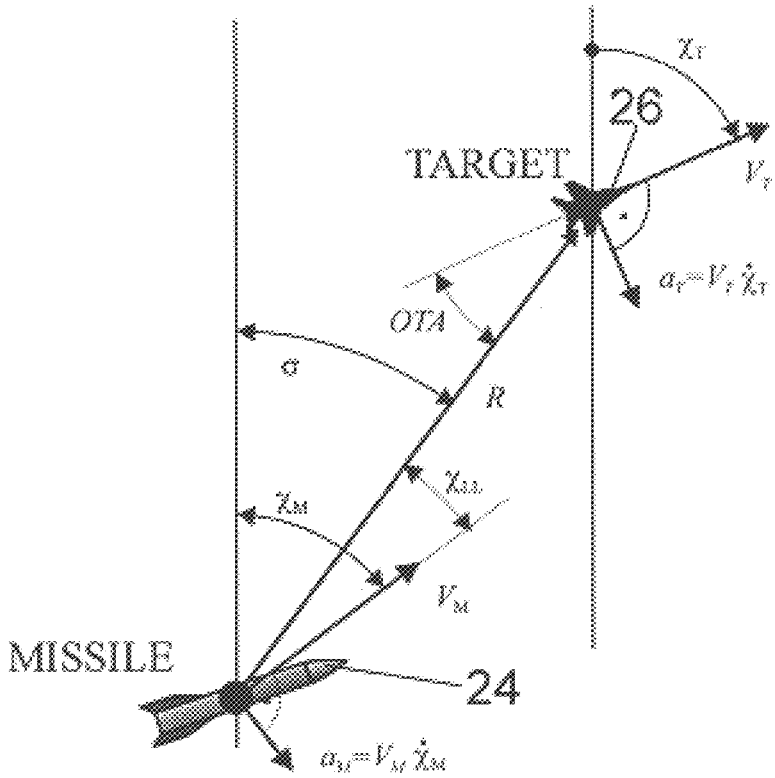
FIG. 2 illustrates the relative geometry of guided missile and target.
Figure 3:
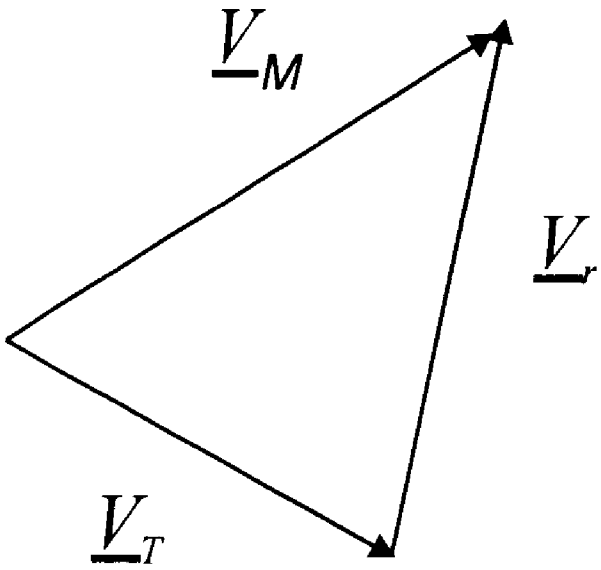
FIG. 3 illustrates the relative speed of guided missile and target.

FIG. 2 shows the relative geometry of guided missile 24 and target 26. The distance vector $R_p$ between guided missile 24 and target at the moment $t_r$ prior to the reaching of the target results from the relation $$\underline{R}_p = R - V_r t_r.$$

Figure 4:
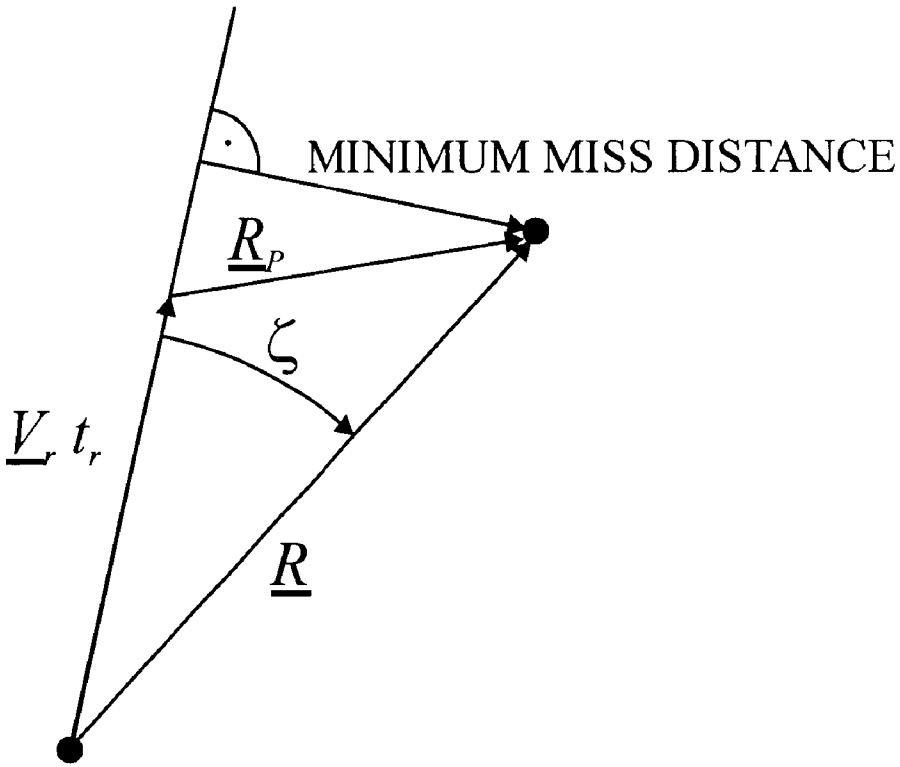
FIG. 4 illustrates the approach geometry.

Therein, R is the actual distance between guided missile and target 26, $V_r$ is the relative speed between guided missile 24 and target 26, and $t_r$ is the time-to-go. It is assumed, that guided missile and target move without acceleration during the short time-to-go. The relative speed $V_r$ between guided missile 24 and target 26 results from FIG. 3:

$$V_r = V_T - V_M,$$

wherein $V_T$ is the target speed and $V_M$ is the speed of the guided missile. The predicted miss distance results as the minimum of the target distance $\underline{R}_p$, thus as the smallest distance of the centers of gravity of guided missile and target. This is illustrated in FIG. 4. This smallest distance is obtained by differentiation of the equation for the predicted distance $\underline{R}_p$ and setting to zero. This yields the time-to-go $t_r$ up to the reaching of this smallest distance.

$$t_r = \frac{\underline{R}\,\underline{V}_r}{|\underline{V}_r|^2}.$$

The relation between the amount of the sight line rate $\dot{\sigma}$ and the target distance R and the relative speed $V_r$ is:

$$\dot{\sigma} = \frac{|\underline{R}|\,|\underline{V}_r|}{|\underline{R}|^2}\sin\varsigma.$$

Therein, as illustrated in FIG. 4, ç is the angle between the vectors of target distance and relative speed.

From the foregoing equations the predicted miss distance $|\underline{R}_p|$ results as $$|\underline{R}_p| = \frac{|\underline{R}|^2}{|\underline{V}_r|}\dot{\sigma}.$$

This shows that the sight line rate $\dot{\sigma}$ is zero, if the relative speed vector points directly to the target 26, thus ç=0. In practice, however, the relative speed vector $V_r$ will always have a certain error angle ç with respect to the target 26. At a certain error angle ç, the sight line rate will rise inversely proportional to the distance-to-go |R|.

With a given distance-to-go |R|, the predicted miss distance $|\underline{R}_p|$ rises proportional to the sight line rate. A heavy increase of the sight line rate $\dot{\sigma}$ shortly before the hit indicates a rather large miss distance.

The above considerations have been made in simplified form for the planar case and the sight line rate $\dot{\sigma}$. The relation between the miss distance and the various influencing variables can be determined by 6-degrees of freedom simulation. This relation can be used for predicting the miss distance from measured influencing variables. By means of the simulation, on a statistical basis, a multitude of encounter situations are examined, wherein the guided missile and target movements are simulated in detail. Relations are obtained from this multitude of encounter situations.

Figure 5:
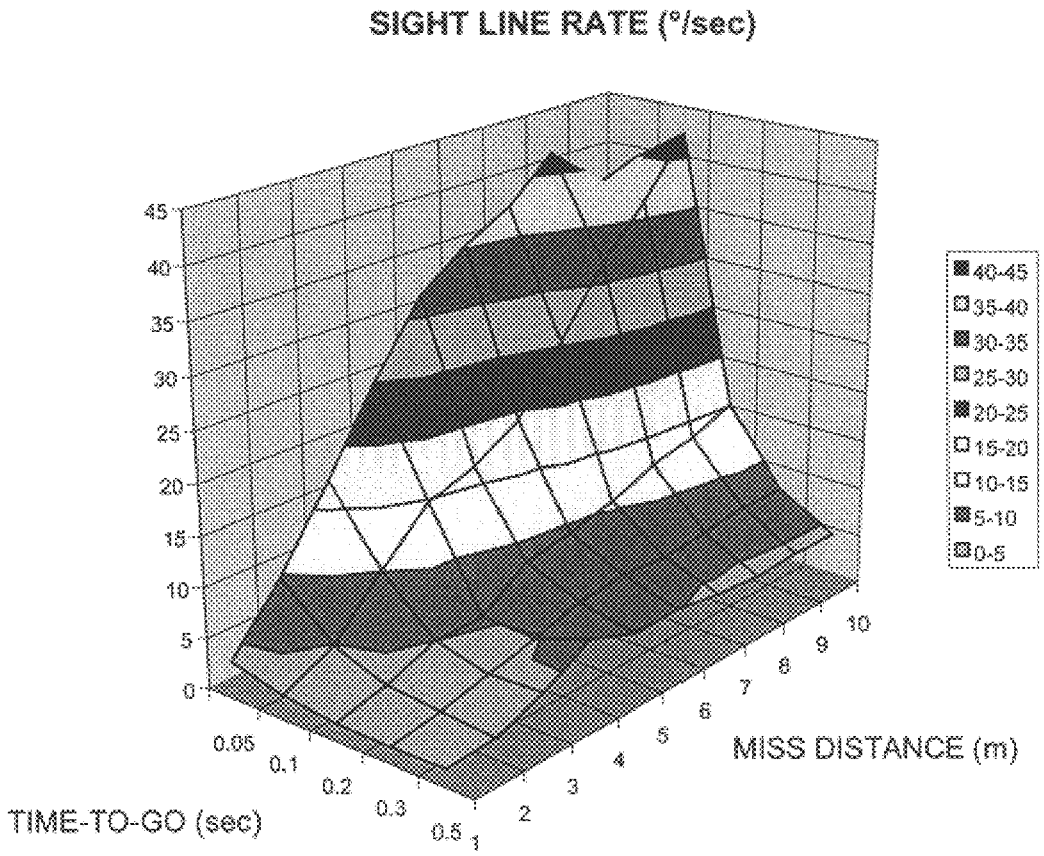
FIG. 5 is a diagram obtained by simulation and shows the relation between miss distance and sight line rate as a function of the time-to-go.

FIG. 5 shows such a relation between miss distance and sight line rate as function of the time-to-go derived from such a 6-degrees of freedom simulation. The horizontal coordinates in FIG. 5 are time-to-go and miss distance. The vertical coordinate is the mean sight line rate. The expected nearly linear rise of the sight line rate as function of the miss distance can clearly be recognized in FIG. 5.

Figure 6:
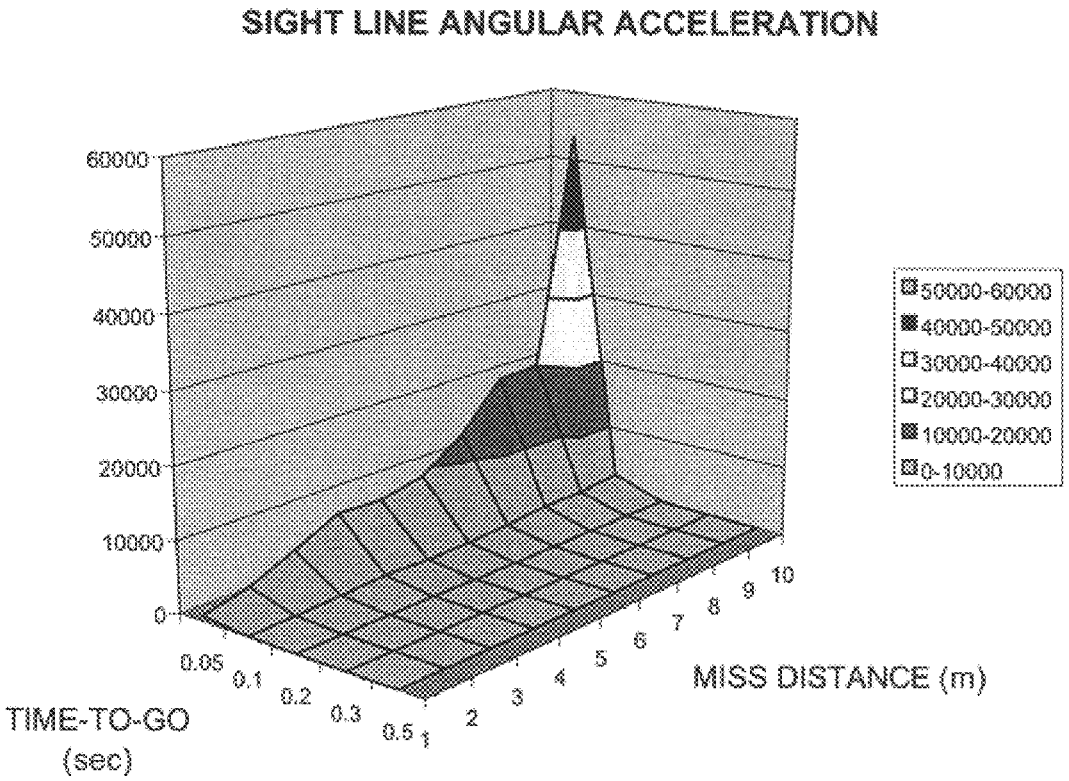
FIG. 6 is a diagram obtained by simulation and shows the relation between miss distance and sight line angular acceleration as a function of time-to-go.

FIG. 6 shows the relation between miss distance and sight line angular acceleration, also derived from a 6-degrees of freedom simulation. The sight line angular acceleration $\sigma$ shows a marked gradient for small times-to-go $t_r$ only. This gradient is, however, very distinct with large miss distances.

FIGS. 5 and 6 show guidance-specific parameters, which are determined by the relative movement of guided missile 24 and target 26, as indicators of the amount of the miss distance. However also missile-specific parameters may be indicators of the amount of the miss distance. Thus, for example, a not perfectly adjusted autopilot may be the cause of disturbed flight behavior of the guided missile, which, in turn may result in increased miss distance. Also operation of the guided missile at the limits of its aerodynamic or flight-mechanical capacity can be used as an indicator of a trend of increased miss distance. Such operation may be characterized by large angles of attack, large control surface deflections or large lateral accelerations. These influences will be referred to, hereinbelow, as "stress factors".

Figure 7:
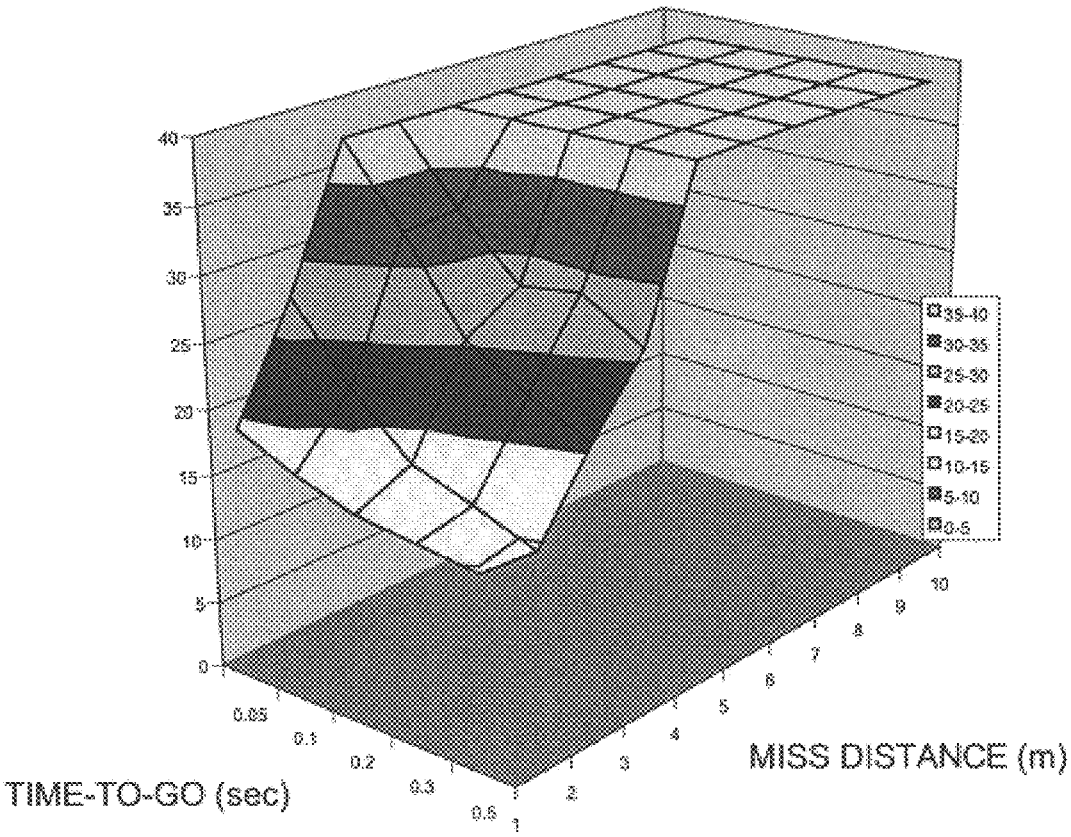
FIG. 7 is a diagram obtained by simulation and shows the relation between miss distance and maximum control surface deflection as a function of the time-to-go.

FIG. 7 shows the relation between miss distance and control surface deflection as a function of time-to-go. This relation has also be derived from 6-degrees of freedom simulation. As a rule, large control surface deflections occur in connection with large angles of attack, large lateral accelerations and large angular rates. FIG. 7 illustrates that large control surface deflections, in particular if they reach the maximum control surface deflection, are combined with increased miss distances.

Figure 8:
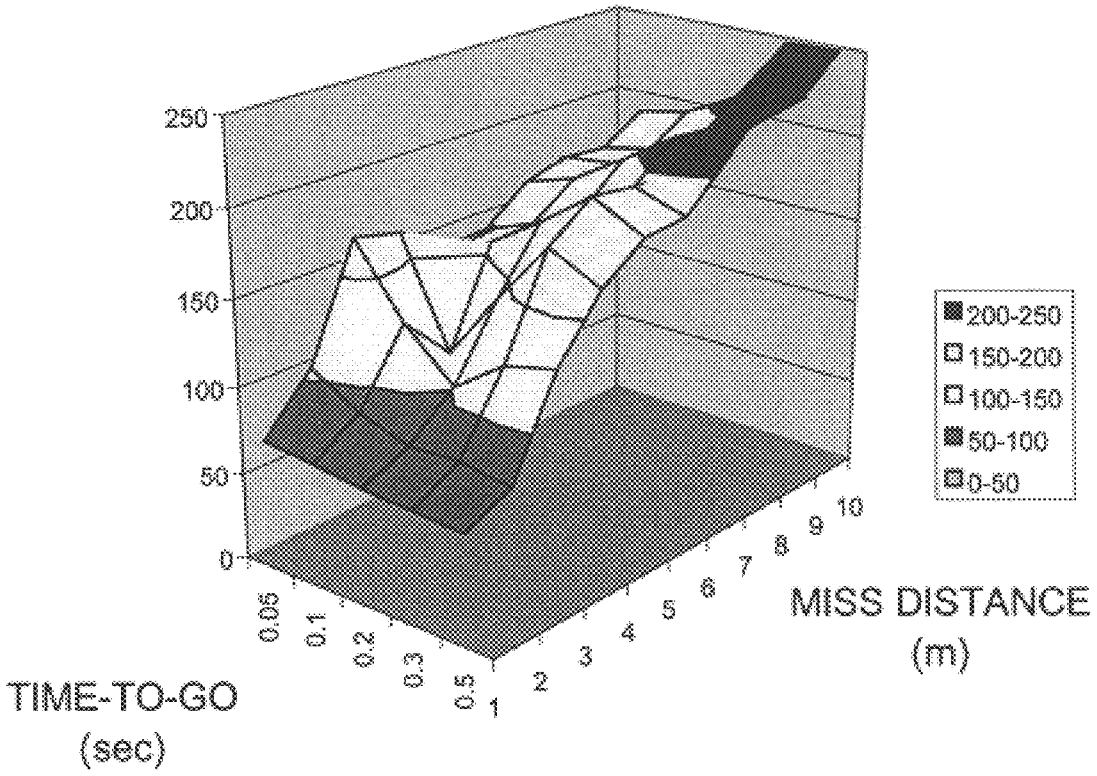
FIG. 8 is a diagram obtained by simulation and shows the relation between miss distance and measured lateral acceleration as a function of the time-to-go.

FIG. 8, eventually, shows the relation, obtained in similar manner as FIG. 7, between miss distance and measured lateral acceleration as a function of time-to-go. The horizontal coordinates in FIG. 8 are time-to-go and miss distance. The vertical coordinate is the measured mean lateral acceleration of the guided missile. High lateral acceleration indicates that the encounter takes place at the operative limit of the guided missile, for example near the inner limit of the launch success zone. Depending on the aerodynamic state, the high lateral acceleration may also be combined with a large angle of attack of the guided missile. Also the lateral acceleration of FIG. 8 shows a clear relation with the miss distance, which increases with high lateral accelerations, and with the time-to-go.

Figure 9:
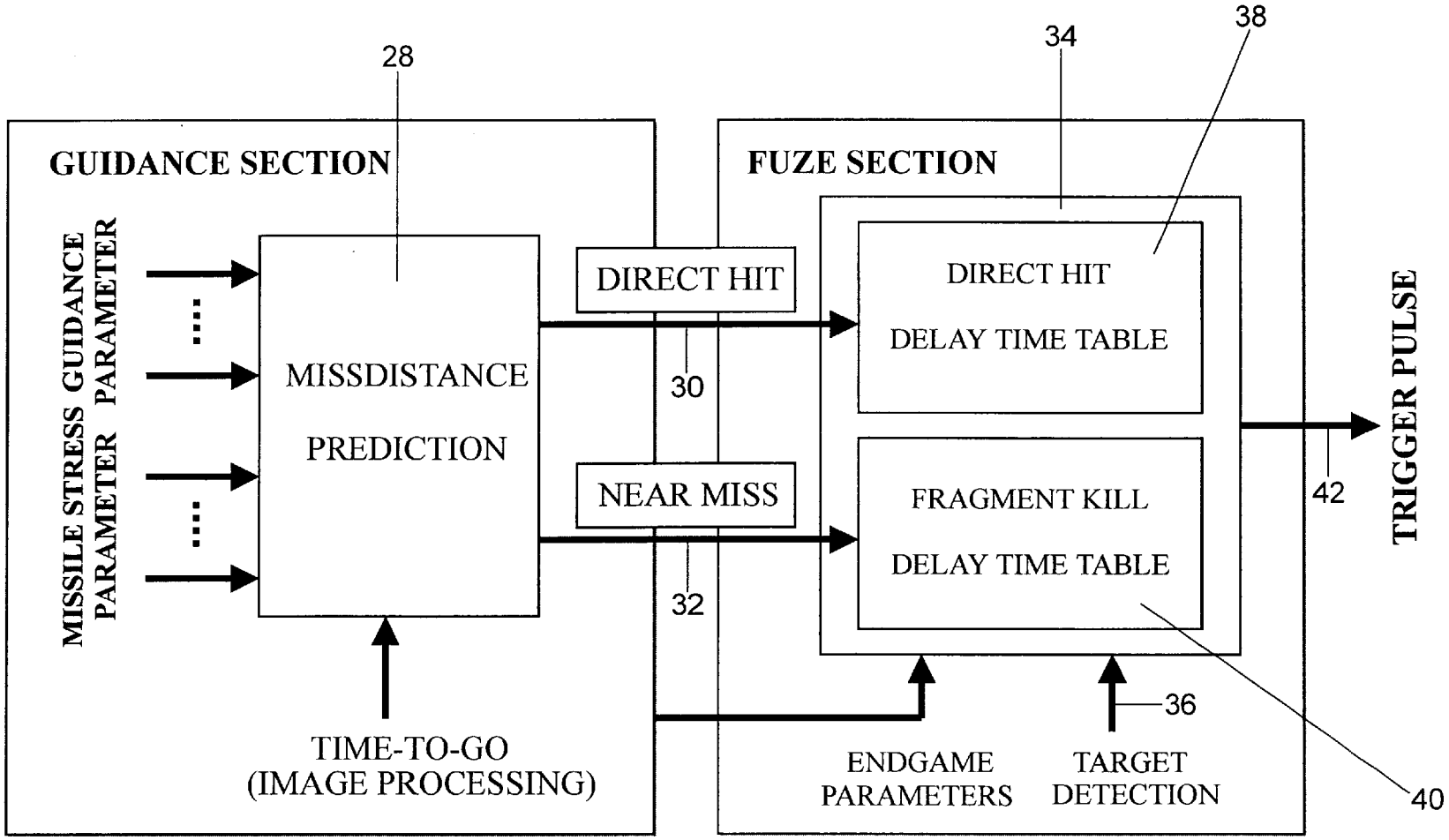
FIG. 9 is a block diagram and shows, in principle, the addition of a direct hit prediction at the interface between guidance unit and fuse.

The various influencing variables, namely the guidance-specific parameters as sight line rate $\dot{\sigma}$ and sight line angular acceleration $\sigma$, on one hand, and the missile-specific parameters such as control surface deflection and lateral acceleration, on the other hand, are applied to a miss distance predictor 28, as illustrated in FIG. 9. In the embodiment of FIG. 9, in addition the time-to-go is applied to the miss distance predictor 28. This time-to-go is estimated by image processing of the seeker image of the seeker head of the guided missile. This is one way of taking the time-to-go into account. The miss distance predictor 28, on the basis of the measured guidance-specific or missile-specific input parameters, predicts either a direct hit by a signal at an output 30 or a near miss by a signal at an output 32. The signals at the outputs 30 and 32 are applied to a fuse section 34. The fuse section 34 comprises a proximity fuse, which responds when the guided missile closely approaches the target. This is indicated by an input 36 "target detection". A table of warhead triggering delay times 38 is associated with the proximity fuse. This table of warhead triggering delay times 38 provides a relatively long first warhead triggering delay time for the proximity fuse. This table of warhead triggering delay times 38 becomes effective, if the miss distance predictor, at output 30, signals a direct hit. Furthermore, a second table of warhead triggering delay times 40 is associated with the proximity fuse. This table of warhead triggering delay times 40 provides a shorter second warhead triggering delay time for the proximity fuse. The first warhead triggering delay time is selected so long that the impact fuse can become operative, before triggering of the warhead through the proximity fuse can be effected. This ensures that the warhead cannot be triggered prematurely prior to the impact of the guided missile on the target. This could happen, if the proximity fuse responds very early and the warhead triggering delay time is set to a relatively short value. The second warhead triggering delay time is shorter than the first warhead triggering delay time. This second warhead triggering delay time is selected such that, with a near miss or passage of the guided missile past the target, maximum destruction of the target is achieved by fragment effect.

Depending on the predicted miss distance, a triggering pulse is generated at an output 42, the warhead triggering delay time of this triggering pulse corresponding to the direct hit or the near miss as explained above.

Figure 10:
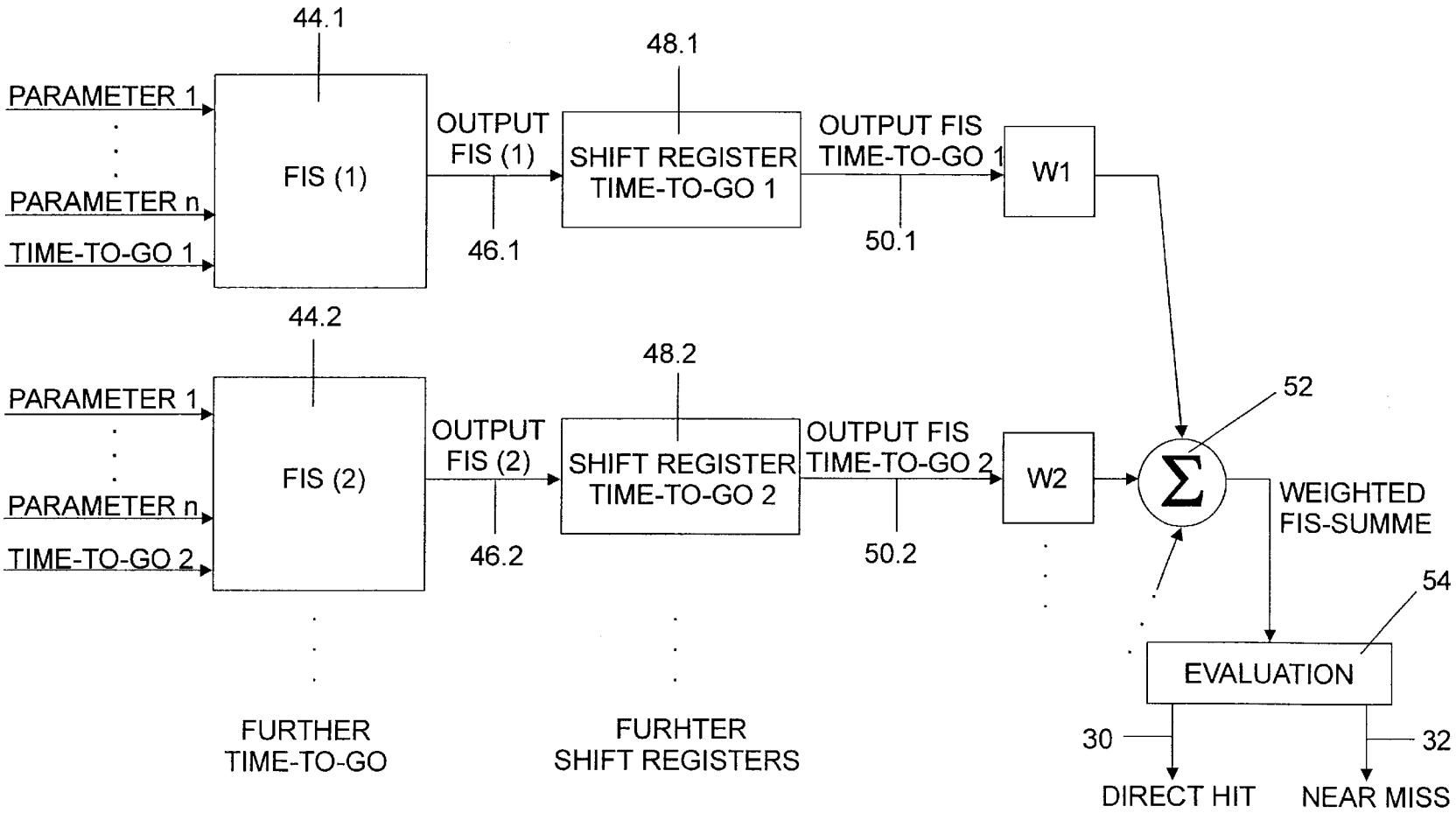
FIG. 10 is a schematic block diagram and illustrates the prediction of the miss distance.

FIG. 10 is a block diagram and illustrates the generation of the "direct hit" and "near miss" signals at the outputs 30 and 32, respectively. As explained above, the measurement or estimation of the time-to-go required for determining the miss distance presents problems. Instead of estimating the time-to-go from the image processing, as in FIG. 9, and to apply this estimated time-to-go to the predictor 28 as a measuring quantity, the preferred embodiment of FIG. 10 provides a continuous estimation of the miss distance in parallel for different, selected times-to-go on the basis of the actual parameters. The miss distances thus determined are delayed by the selected warhead triggering delay time, on which the estimation was based. When the proximity fuse responds estimations of the miss distance are available which, for example, are based on the influencing variables determined half a second ago and assumed, when estimating this miss distance, a time-to-go of half a second; are based on the influencing variables determined a quarter of a second ago and assumed, when estimating this miss distance, a time-to-go of a quarter of a second etc. A weighted mean is formed from these miss distances, which are all referenced to the response time of the proximity fuse and therefore are comparable. It may be advantageous, when forming the mean, to more heavily weight the estimations based on shorter times-to-go.

Figure 11:
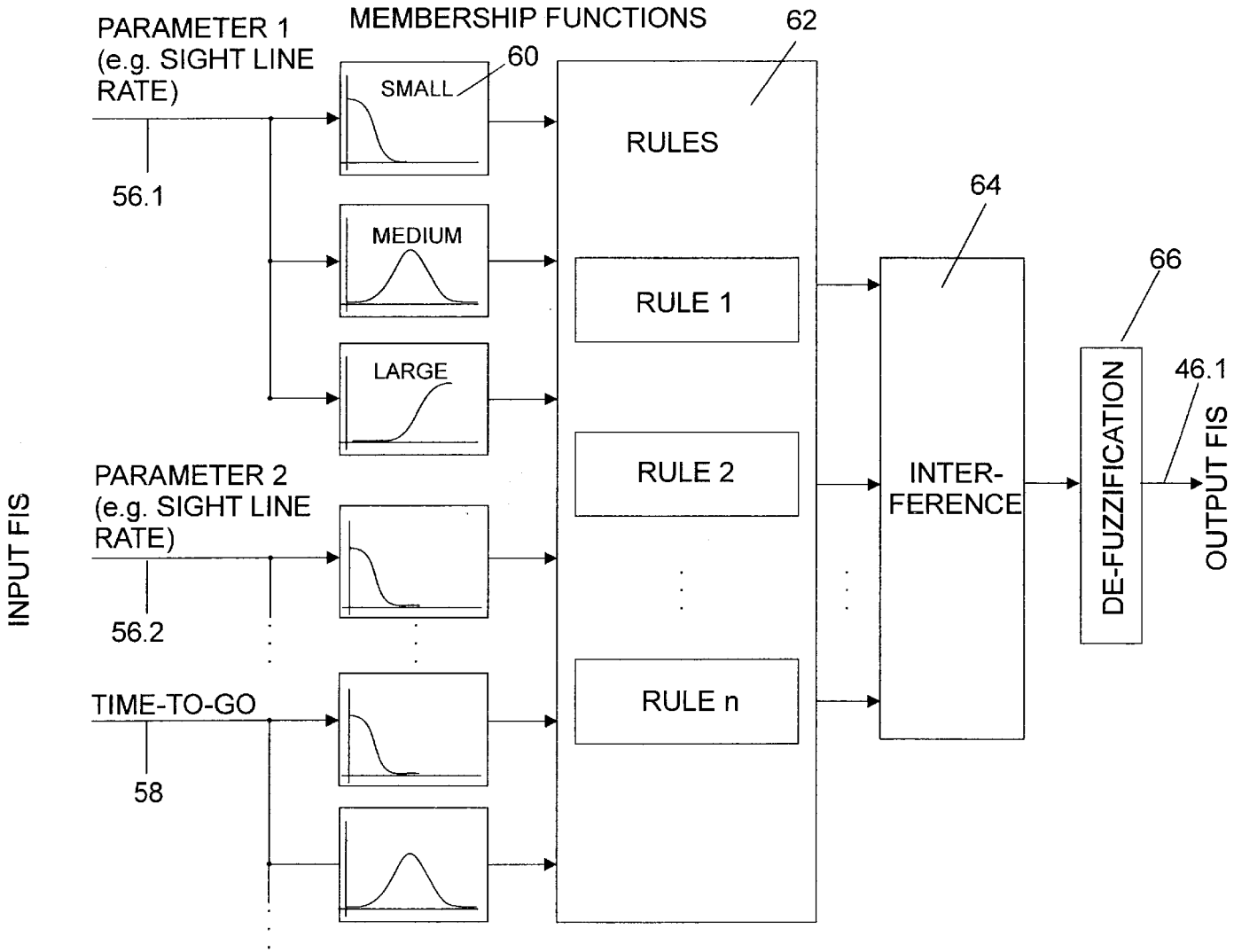
FIG. 11 illustrates a "fuzzy inference" system provided for predicting the miss distance.

The influencing variables or parameter described with reference to FIGS. 5 to 8 provide indications of the miss distance to be expected. The miss distance can, however, not simply be computed in accordance with a certain algorithm. For this reason, the estimation of the miss distance on the basis of the assumed time-to-go is effected by "fuzzy inference" systems. This is illustrated in FIG. 11. The influencing variables are transformed into linguistic quantities, such as "large", "medium", "small", by means of membership functions. As the membership functions, as a rule, overlap, a particular value of an influencing variable may be associated to different linguistic quantities with certain percentages ("membership factors"), thus, for example, be "large" by 75 percent and "medium" by 25 percent. The linguistic quantities are then processed in accordance with given inference rules of the film "if . . . , then . . . ". The results of the inference are linked in accordance with the membership factors. The "de-fuzzification" then yields a numerical output quantity. This is a technique known per se.

Referring to FIG. 10, a plurality of such "fuzzy inference systems" 44.1, 44.2 . . . 44.m are provided. Each of these fuzzy inference systems has the actual influencing variables continuously applied thereto and assumes an associated time-to-go $t_{r1}$, $t_{r2}$, . . . $t_{rm}$. Shift registers 48.1, 48.2, . . . 48.m serve to delay the respective output quantities by the associated time-to-go $t_{r1}$, $t_{r2}$, . . . $t_{rm}$. Then predicted miss distances w1, w2, . . . wm comparable with respect to time are presented at the outputs 50.1, 50.2, . . . 50.m. These predicted miss distances are summed at a summing point in a weighted manner. The weighted sum is applied to an evaluation circuit 54. Then this evaluation circuit 54 provides signals "direct hit" or "near miss" at outputs 30 and 32, respectively, as explained with reference to FIG. 9.

FIG. 11 shows schematically one of the fuzzy inference systems illustrated in FIG. 10.

The fuzzy inference system, for example 44.1, has inputs 56.1, 56.2, . . . 56.n for the various guidance-specific or missile-specific influencing variables or parameters. Furthermore, the fuzzy inference system has an input 58, to which a selected time-to-go $t_{r1}$ . . . associated with the respective fuzzy inference system is applied. As shown completely in FIG. 11 for the input 56.1, each input is connected in parallel to sorting elements 60, by which the applied input quantity, for example the sight line rate $\dot{\sigma}$, is associated to a linguistic quantity "small", "medium", or "large" with a membership factor determined by a membership function. The linguistic quantities thus obtained are supplied to a rule base 62. Rules in the form "if . . . , then . . ." are stored in the rule base, for example a rule: If ($t_1$={small}and $\dot{\sigma}$={small}), then (missdistance={small}). All addressed rules, i.e. all rules in which parameters appear as linguistic quantities with a membership factor, provide linguistic quantities having membership factors which result from the membership factors of the occurring parameters. This is illustrated in FIG. 11 by block 64. The results of the various rules are combined in a sum and again provide a numerical value. This is illustrated in FIG. 11 by a block 66 "de-fuzzification" having an output 46.1.

Figure 12:
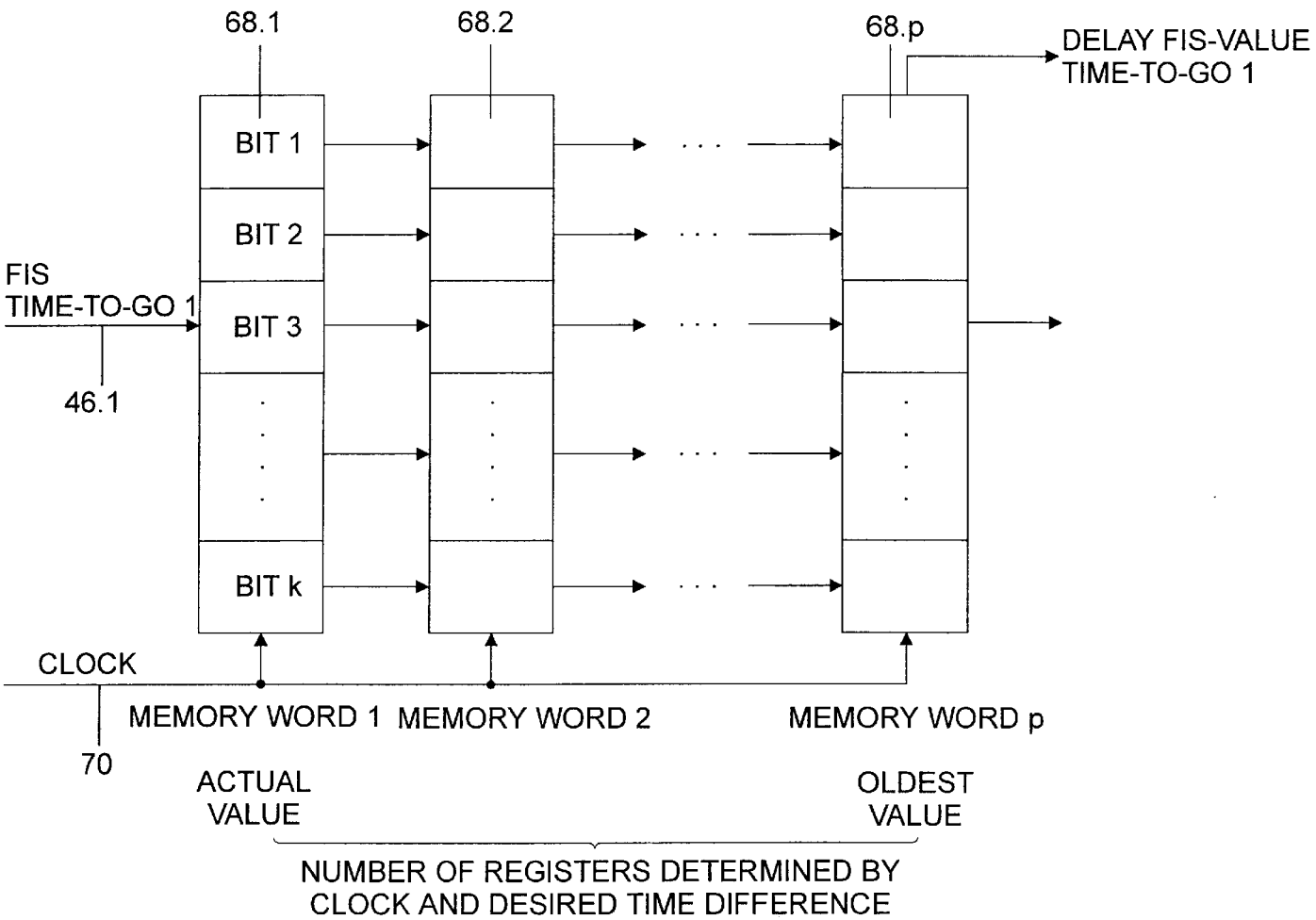
FIG. 12 illustrates the delay of the predicted miss distance by the time-to-go assumed for the prediction.

FIG. 12 shows the shift register for delaying the predicted miss distance by a time-to-go, this shift register representing, for example, shift register 48.1 of FIG. 10.

The shift register 48.1 comprises register 68.1, 68.2, . . . 68.p. The respective actual value of the predicted miss distance is read-in into the register 68.1 by the fuzzy inference system 44.1 from the output thereof with bits l to k. The shift register 48.1, as the remaining shift registers is controlled by a clock from a clock input 70. The respective actual predicted miss distance from the fuzzy inference system 44.1 is read-in into the register 68.1 as a memory word. By a clock pulse, this memory word is transferred from the register 68.1 to the register 68.2. At the same time, the memory word previously stored in the resister 68.2 is transferred to the next register 68.3 etc., while the new actual predicted miss distance is read-in into the register 68.1. After p clock pulses, which represent the selected time-to-go, the memory word read-in into the register 68.1 has reached the register 68*p* and is available there for read-out as delayed predicted miss distance w1 (FIG. 10).

We claim:

1. A method of triggering a warhead in a target-tracking guided missile having an impact fuse and a proximity fuse, said proximity fuse responding to the guided missile approaching a target, the impact fuse being operative to detonate the warhead upon impact of the guided missile on the target, and the proximity fuse being operative to detonate the warhead triggering delay time relative to the responding of the proximity fuse, said method comprising the steps of:

detecting influencing variables which are determinative of the guided missile either directly impacting against said target or alternatively passing said target, and setting said warhead triggering delay time dependent on said influencing variables for selectively impacting or passing said target by said guided missile.

2. A method as claimed in claim 1, wherein a predicted miss distance is determined from said detected influencing variables, and said warhead triggering delay time is set dependent on said predicted miss distance.

3. A method as claimed in claim 2, wherein said predicted miss distance is derived from said influencing variables and the time-to-go which the guided missile has to traverse until it reaches said target.

4. A method as claimed in claim 2, wherein upon said predicted miss distance indicating a direct hit to be expected, then a warhead triggering delay time of such length is set to permit triggering of said warhead by said impact fuse upon impact of said guided missile on said target.

5. A method as claimed in claim 2, wherein upon said predicted miss distance indicating a near miss of the guided missile to be expected, then a warhead triggering delay time is set which is optimized with respect to the efficiency of a warhead detonating laterally of said target.

6. A method as claimed in claim 3, wherein the relationship between said miss distance, said influencing variables and the time-to-go of the guided missile is determined by simulation and is stored.

7. A method as claimed in claim 1, wherein said influencing variables include quantities which result from the geometric relation of target and guided missile.

8. A method as claimed in claim 7, wherein at least one of said geometry-related influencing variables is selected from the group consisting of: sight line rate and sight line acceleration.

9. A method as claimed in claim 1, wherein said influencing variables include missile-specific quantities indicative of states of the guided missile.

10. A method as claimed in claim 9, wherein at least one of said missile-specific influencing variables is selected from the group consisting of control surface deflection, angle of attack and lateral acceleration.

11. A method as claimed in claim 3, wherein an image of said target is generated on an image-resolving detector of said guided missile, and said image is processed to provide an estimate of said time-to-go.

12. A method as claimed in claim 3, comprising the steps of:

continuously determining a predicted miss distance from said influencing variables and for a selected time-to-go, and delaying said miss distance predicted on the basis of said selected time-to-go by said selected time-to go and determining said warhead triggering delay time, when said proximity fuse responds, on the basis of said delayed predicted miss distance.

13. A method as claimed in claim 12, wherein a plurality of predicted miss distances are determined from the influencing variables, in parallel, based on different associated times-to go, each predicted miss distance determined on the basis of an associated time-to-go is delayed by said associated time-to-go and is read out, with this delay, for the determination of the warhead triggering delay time when the proximity fuse responds, and a mean of said predicted miss distances read out with delay is formed for determining said warhead triggering delay time therefrom.

14. A method as claimed in claim 13, wherein said mean is a weighted mean.

15. A method as claimed in claim 14, wherein, when said weighted mean is formed, heavier weights are associated with predicted miss distances based on relatively short selected times-to-go than with predicted miss distances based on relatively long selected times-to-go.

16. A device for triggering a warhead in a target-tracking guided missile during an encounter between said guided missile and a target, comprising an impact fuse and a proximity fuse, said proximity fuse responding, when said guided missile closely approaches said target, and triggering detonation of said warhead with a warhead triggering delay time after said response of said proximity fuse, said device comprising:

means for detecting influencing variables which are determinative of the guided missile either directly impacting against said target or alternatively passing said target during the flight of said guided missile, and setting means for setting said warhead triggering delay time dependent on said influencing variables for selectively impacting or passing said target by said guided missile.

17. A device as claimed in claim 16, wherein said setting means comprise means for determining a predicted miss distance from said influencing variables and means for determining said warhead triggering delay time depending on said predicted miss distance.

18. A device as claimed in claim 17, and further comprising means for determining the time-to-go which the guided missile has to traverse until it reaches said target, said warhead triggering delay time determining means being operative to derive said predicted miss distance form said influencing variables and said time-to-go.

19. A device as claimed in claim 17, wherein said warhead triggering time determining means comprise discriminating means for detecting, whether said predicted miss distance indicates a direct hit to be expected or whether said predicted miss distance indicates a near miss to be expected, and said setting means are operative to provide a warhead triggering delay time of a length permitting impact of said guided missile on said target, if said predicted miss distance indicates a direct hit to be expected, to permit triggering of the warhead by said impact fuse, and to provide a warhead triggering delay time optimized with regard to the efficiency of said warhead detonating lateral of said target, if said predicted miss distance indicates a near miss to be expected.

20. A device as claimed in claim 18, and further comprising memory means for storing the relation between said miss distance, said influencing variables and said time-to-go as determined by simulation.

21. A device as claimed in claim 16, wherein said means for detecting influencing variables comprises means for detecting guidance-specific influencing variables which result from the geometric relation of target and guided missile.

22. A device as claimed in claim 21, wherein at least one of said geometry-related influencing variables is selected from the group consisting of: sight line rate and sight line acceleration.

23. A device as claimed in claim 16, wherein said means for detecting influencing variables include means for missile-specific quantities indicative of states of the guided missile.

24. A device as claimed in claim 23, wherein at least one of said missile-specific influencing variables is selected from the group consisting of: control surface deflection, angle of attack and lateral acceleration.

25. A device as claimed in claim 18, wherein said guided missile has an image resolving seeker head providing an image of said target said time-to-go determining means comprising image processing means for processing said target image to estimate said time-to-go from the changes of the dimensions of said target image.

26. A device as claimed in claim 18, wherein said warhead triggering delay time determining means comprises means for continuously determining predicted miss distance based on said influencing variables and a fixed, selected time-to-go, delay means for delaying the predicted miss distance, thus determined for said selected time-to-go, by said selected time-to-go, and means for determining said warhead triggering delay time from said delayed predicted miss distance, when said proximity fuse responds.

27. A device as claimed in claim 26, wherein said predicted miss distance determining means comprise a plurality of channels, each channel having applied thereto said influencing variables and being operative to determining predicted miss distance on the basis of an associated selected time-to-go different from the times-to-go associated with the remaining ones of said channels, said delay means comprising channel delay means in each of said channels, each of said channel delay means being operative to delay the predicted miss distance determined in said channel by the selected time-to-go associated with said channel.

28. A device as claimed in claim 27, wherein said warhead triggering delay time determining means comprises means for forming a mean of said delayed predicted miss distances from said channels, and means for determining said warhead triggering delay time front said mean.

29. A device as claimed in claim 28, wherein said mean is a weighted mean.

30. A device as claimed in claim 29, wherein, when said weighted mean forming means are operative to associate heavier weights with predicted miss distances based on relatively short selected times-to-go than with predicted miss distances based on relatively long selected times-to-go.

31. A device as claimed in claim 17, wherein said means for determining a predicted miss distance from said influencing variables comprises a fuss-inference system.

* * * * *